US005778534A

United States Patent [19]

Kim

[11] Patent Number: 5,778,534

[45] Date of Patent: Jul. 14, 1998

[54] METHOD OF MAKING EXHAUST VALVES FOR USE IN AUTOMOBILES

[75] Inventor: Sang-ho Kim, Seoul, Rep. of Korea

[73] Assignee: Kia Motors Corporation, Seoul, Rep. of Korea

[21] Appl. No.: 683,636

[22] Filed: Jul. 15, 1996

[30] Foreign Application Priority Data

Apr. 4, 1996 [KR] Rep. of Korea ..... 96-10247

[51] Int. Cl.[6] ..... B21K 1/22

[52] U.S. Cl. ..... 29/888.451; 123/188.3

[58] Field of Search ..... 29/888.4, 888.451; 123/188.3

[56] References Cited

U.S. PATENT DOCUMENTS

| | | | |
|---|---|---|---|
| 2,734,008 | 2/1956 | Kirkpatrick et al. | 29/888.451 |
| 3,286,704 | 11/1966 | Danis | 29/888.451 |
| 4,729,546 | 3/1988 | Allison | 123/188.3 |
| 5,112,415 | 5/1992 | Mae | 123/188.3 |
| 5,169,460 | 12/1992 | Mae | 123/188.3 |
| 5,257,453 | 11/1993 | Neumann et al. | 29/888.451 |
| 5,662,745 | 9/1997 | Takayama et al. | 123/188.3 |

*Primary Examiner*—Erick R. Solis

[57] ABSTRACT

A method of making an exhaust valve for use in an automobile is disclosed. The exhaust valve is manufactured by forging Ti-6Al-2Sn-4Zr-2Mo-0.1Si alloy at a temperature of 1000°–1200° C., and annealing the forged alloy by cooling after maintaining it at a temperature of 1020°–1060° C. for 0.5–1.5 hours. The method further includes the step of stress relieving the forged alloy, the stress relieving step including a cooling step after maintaining the forged alloy at a temperature of 600–700° C. for 1.5–2.5 hours. A strain rate of the forging step is 0.5–5/S, and the cooling of the annealing step includes a control cooling step at 0.6°–0.7° C./sec or the cooling of the stress relieving step includes an air cooling step. The exhaust valve has improved hardness.

7 Claims, 3 Drawing Sheets

Fig.1 Effects of Forging Conditions on Flow Stress of Ti-6Al-4V alloy

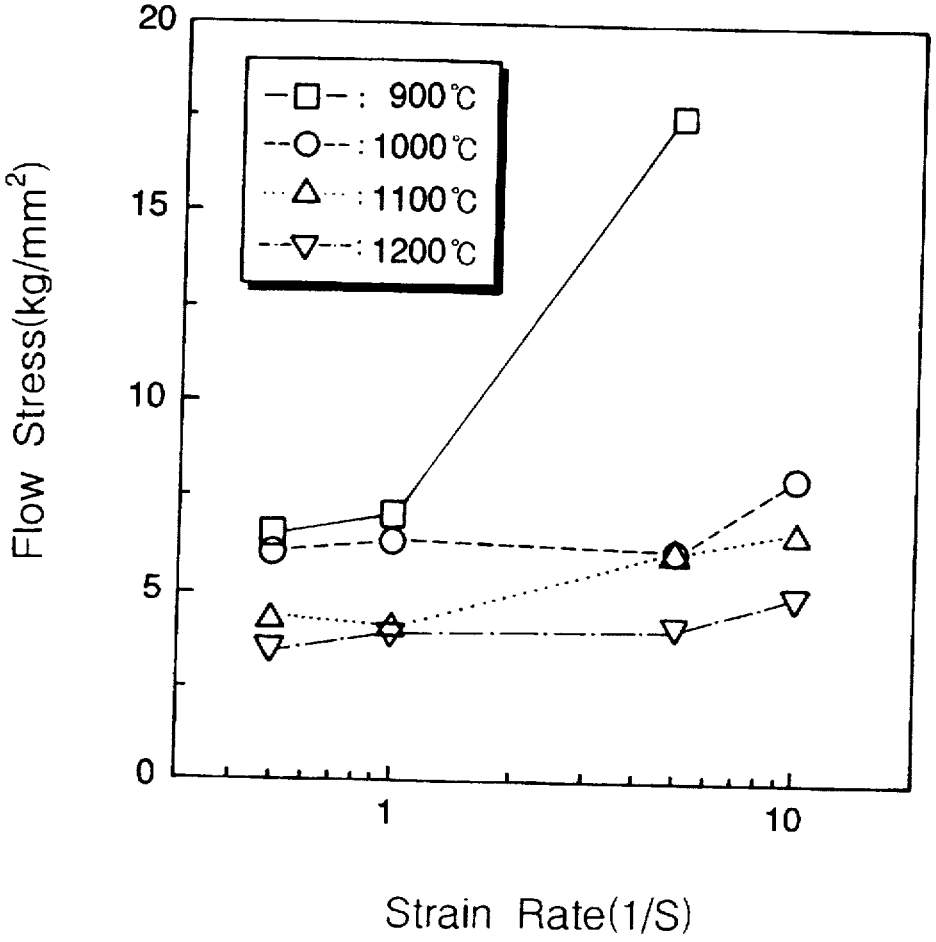
Fig.1 Effects of Forging Conditions on Flow Stress of Ti-6Al-4V alloy

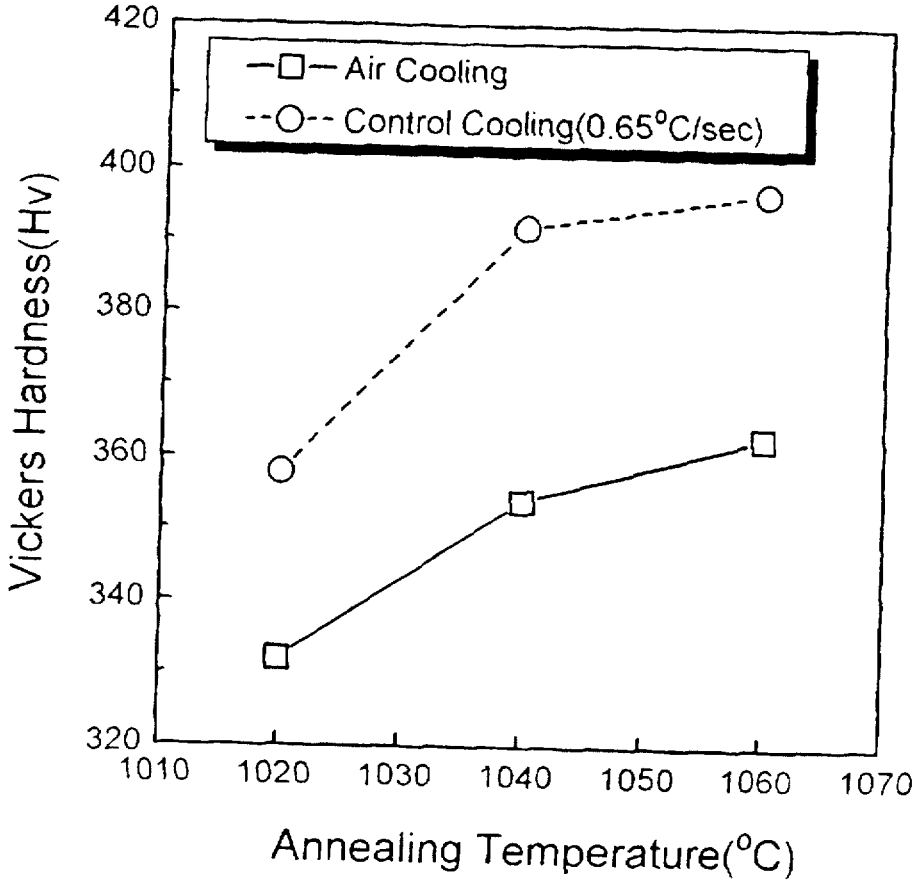
Fig.2 Effects of Annealing Conditions on Vickers Hardness of Ti-6Al-2Sn-4Zr-2Mo alloy

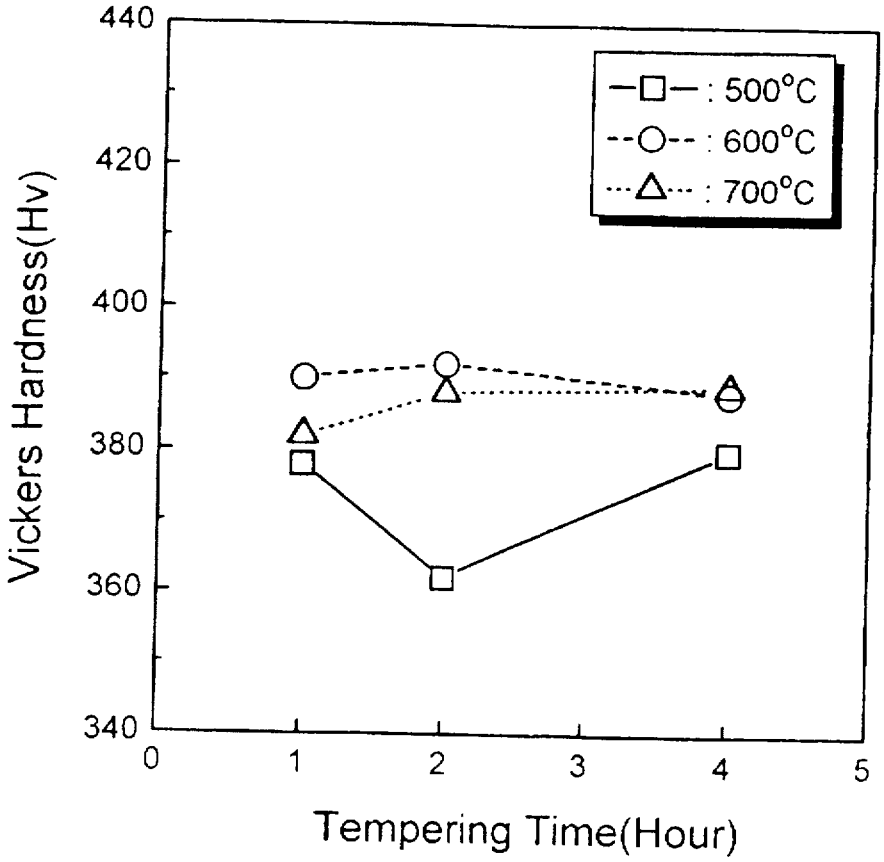
Fig.3 Effects of Tempering Conditions on Vickers Hardness of Ti-6Al-2Sn-4Zr-2Mo alloy

METHOD OF MAKING EXHAUST VALVES FOR USE IN AUTOMOBILES

BACKGROUND

The present invention relates to a method of making an exhaust valve for use in an automobile and, more particularly, to a method of making the exhaust valve for use in an engine using a light Ti alloy.

In the prior art, the valve for engines is usually made from a heat-resisting alloy SUS35. The engine valve which reciprocates in a cylinder head plays an important part in determining the performance of the engine. If motion performance of motion of the valve is improved by reducing the weight of the engine valve, the movement of the valve becomes reliable and exact, thereby improving the efficiency of exhaust. (or exhaust efficiency)

If the weight of the engine valve is reduced, the output and torque of the engine are increased. Therefore much work has gone into efforts to lighten the engine valve by changing its shape.

Since the reduction of weight using the same material is limited, studies of making the engine valve using a light Ti alloy have been undertaken with the object of making an application of a light Ti alloy engine valve to sports cars practical.

However, since the exhaust valve made of Ti alloy has problems in properties of matter, it is necessary to replace broken valves often.

SUMMARY

It is, therefore, an object of the invention to provide a method of making an exhaust valve using Ti-6Al-2Sn-4Zr-2Mo-0.1Si material capable of improving productivity and reliability of manufactured goods.

To achieve the object, there is provided a method of making an exhaust valve, comprising the steps of forging Ti-6Al-2Sn-4Zr-2Mo-0.1Si alloy at a temperature of 1000°–1200° C., and annealing the forged alloy by cooling after maintaining it at a temperature of 1020°–1060° C. for 0.5–1.5 hours.

The method further includes the step of stress relieving the forged alloy. The stress relieving step comprising the step of cooling after maintaining the forged alloy at a temperature of 600°–700° C. for 1.5–2.5 hours.

A strain rate of the forging step is 0.5 . 5/S, the cooling of the annealing step comprises the step of control cooling at 0.6°–0.7° C./sec and the cooling of the stress relieving step comprises the step of air cooling.

The annealing step and the stress relieving step execute heat treating for 1 hour and 2 hours, respectively.

Other features and objects of the present invention will be apparent from the following description in connection with the accompanying drawings.

BRIEF DESCRIPTION OF THE DRAWINGS

FIG. 1 is a graph showing the effects of forging conditions on flow stress of Ti-6Al-2Sn-4Zr-2Mo-0.1Si alloy according to the present invention;

FIG. 2 is a graph showing the effects of forging conditions on Vickers hardness of Ti-6Al-2Sn-4Zr-2Mo-0.1Si alloy according to the present invention; and FIG. 3 is a graph showing the effects of tempering conditions on flow Vickers hardness of Ti-6Al-2Sn-4Zr-2Mo-0.1Si alloy according to the present invention.

DESCRIPTION

A preferred embodiment according to the present invention will be now explained in detail with reference to the accompanying graphs.

A. Method of Experiment

The material of the exhaust valve was used Ti-6Al-2Sn-4Zr-2Mo-0.1Si manufactured by Dynamet Inc, U.S.A. In order to find the proper forging conditions when forging, an experiment of hot compression was carried out. A tester of hot working reproducibility "Termecmaster-Z" of high frequency induction was used in this experiment. The heating temperature was set between 900° and 1200° C. having 100° C. spacing on the basis of 1000°. That is, a temperature of β transformation, and the strain rates were 0.5/S, 1/S, 5/S, and 10/S, respectively. The strain applied to all the specimens was true strain $\epsilon=1$.

The heat treatment was carried out at a temperature higher than that of β transformation to have a micro organization of colony uniformly transformed β phase excellent in resistance of creep, suppression of fatigue crack propagation and characteristic of fatigue. The control cooling is carried out at 0.65° C./sec.

After maintaining the alloy at temperatures of 1020°, 1040° and 1060° for 1 hour, respectively, the air cooling and the control cooling were carried out, and after heat treatment, Microvickers hardness was measured as physical properties.

After the first heat treatment, conditions of optimal heat treatment of the valve were chosen and after choosing the first heat treatment chosen, heat treatment of stress relieving is was conducted. The heat treatments of stress relieving are carried out at 500°, 600° and 700° C. and air-cooled after maintaining the alloy at the above 2, 4 and 4 hours.

As the first heat treatment, Microvickers hardness was measured according to conditions of respective stress relieving heat treatment.

B. Results of experiment

As shown in FIG. 1, flow stress is rapidly increased at a temperature of below 900° C., that is, temperature below β transformation and the strain rate has small effects. According as the heating temperatures are increased above 1200° C., roughness of surface becomes rapidly deteriorated. Therefore, proper forging conditions are set at temperatures between 1000° C. and 1200° C. and the proper strain rate is below 5/S.

Table 1 and FIG. 2 show hardness measured by a Microvickers hardness tester at load of 1 kg after the first heat treatment. The highest degree of hardness was seen when the specimen was air-cooled at a temperature of 1060° C. for a duration of 1 hour. In this case, hardness of a stem is 391.3 Hv and that of a head is 397 Hv. Since the colony size is big in the micro organization, the heat treatment at 1040° C. showing hardness (stem; 364.3 Hv, head; 392.3 Hv) slightly lower than that at 1060° C. heat treatment is preferable.

It is preferable to control cool (0.6°–0.7° C./sec) rather than air cool.

TABLE 1

Hardness on Heat Treatment of Exhaust Valve of Ti Alloy (Load 1 kg, Hv)

| Condition on Heat Treatment | Hardness Stem | Hardness Head |
|---|---|---|
| 1020° C./1H/AC | 346.2 | 334.2 |
| 1020° C./1H/CC | 359.7 | 358.2 |
| 1040° C./1H/AC | 358.3 | 356.0 |
| 1040° C./1H/CC | 364.3 | 392.3 |
| 1060° C./1H/AC | 350.7 | 366.3 |
| 1060° C./1H/CC | 391.3 | 397.0 |

Since the hardness of the stem using a heat resisting steel SUH35 in the prior art valve is 297 Hv, the material of Ti-6Al-2Sn-4Zr-2Mo-0.1Si alloy showed excellent properties.

After the first heat treatment, the hardness of the valve was increased by heat treatment of stress relieving, and its results are shown in Table 2 and FIG. 3. As seen in the above, heat treatment of stress relieving at 600° for 2 hours shows optimal hardness(stem; 389.5 Hv, head; 386.5 Hv) in an economic respect. The heat treatment of stress relieving at 500° C. and 600° C. for 4 hours shows that differences of hardness between the stem and the head are great and at 700° C. shows high values without difference between them (stem; 389 Hv, head; 402 Hv). Further, the hardness of heat treatment for 6 hours is similar to that of heat treatment for 2 hours.

TABLE 2

Hardness on Heat Treatment of Stress Relieving (Load 1 kg, Hv)

| Condition on Heat Treatment | Hardness Stem | Hardness Head |
|---|---|---|
| 500° C./2H/AC | 378.5 | 367.3 |
| 500° C./4H/AC | 345.8 | 393.5 |
| 500° C./6H/AC | 380.0 | 379.5 |
| 600° C./2H/AC | 389.5 | 386.5 |
| 600° C./4H/AC | 392.3 | 374.5 |
| 600° C./6H/AC | 386.8 | 368.0 |
| 700° C./2H/AC | 382.3 | 375.5 |
| 700° C./4H/AC | 389.0 | 402.0 |
| 700° C./6H/AC | 387.5 | 383.3 |

Therefore, the colony exists in prior β boundary having big grain size, relatively high hardness is shown when 1040° C. for 1 hour and control cooling, the heat treatment of stress relieving has not great effect on change in the micro organization and in case of necessitating increase of hardness, the heat treatment of stress relieving of 600° C./2 hours or 700° C./4 hours enables the increase of 10–25 Hv.

Therefore, this invention provides the optimal method of making an exhaust valve using Ti-6Al-2Sn-4Zr-2Mo-0.1Si material capable of having improved hardness as compared with prior art heat resisting steel SUH35.

The foregoing description is for purpose of illustration only. It will be readily understood that many variations thereof, which will not depart from the spirit of the invention, will be apparent to those skilled in the art.

What is claimed is:

1. A method of making an exhaust valve, comprising the steps of:

forging Ti-6Al-2Sn-4Zr-2Mo-0.1Si alloy at a temperature of 1000°–1200° C.;

annealing the forged alloy by cooling after maintaining it at a temperature of 1020°–1060° C. for 0.5–1.5 hours; and comprising the further step of stress relieving the forged alloy, wherein the stress relieving step comprises the step of cooling after maintaining the forged alloy at a temperature of 600°–700° C. for 1.5–2.5 hours.

2. A method according to claim 1, wherein a strain rate of the forging step is below 5/S.

3. A method according to claim 1, wherein the cooling of the annealing step comprises the step of control cooling at 0.6°–0.7° C./sec.

4. A method according to claim 1, wherein the cooling of the stress relieving step comprises the step of air cooling.

5. A method according to claim 1, wherein the annealing step carries out a heat treatment for 1 hour.

6. A method according to claim 1, wherein the stress relieving step carries out at a temperature of 600° C. for 2 hours.

7. A method according to claim 1, the stress relieving step carries out during 4 hours at a temperature of 700° C.

* * * * *